United States Patent [19]

Alloue et al.

[11] 4,421,828

[45] Dec. 20, 1983

[54] STEEL SHEET CARRYING A PROTECTIVE LAYER AND PROCESS FOR PRODUCING SUCH A SHEET

[75] Inventors: Raymond Alloue; Claude Mergey, both of Ville d'Avray, France

[73] Assignee: Carnaud S.A., Boulogne, France

[21] Appl. No.: 184,863

[22] Filed: Sep. 8, 1980

[30] Foreign Application Priority Data

Sep. 6, 1979 [FR] France ..... 79 22322

[51] Int. Cl.[3] ..... B32B 15/18; C25D 5/10

[52] U.S. Cl. ..... 428/629; 204/38 B; 204/41; 204/56 R; 428/639; 428/646; 428/648; 428/666

[58] Field of Search ..... 204/35 R, 35 N, 37 T, 204/38 R, 38 B, 41, 56 R; 427/405, 419.2; 428/629, 639, 648, 646, 666

[56] References Cited

U.S. PATENT DOCUMENTS

| | | | |
|---|---|---|---|
| 3,278,401 | 10/1966 | Smith et al. | 204/56 R |
| 3,296,100 | 1/1967 | Yonezaki et al. | 204/41 |
| 3,616,303 | 10/1971 | Carter, Jr. | 204/41 |
| 3,642,587 | 2/1972 | Allen et al. | 204/35 N |
| 3,679,554 | 7/1972 | Yamagishi et al. | 204/56 |
| 3,682,796 | 8/1972 | Deubedi et al. | 204/97 |
| 3,718,509 | 2/1973 | Germano | 148/6.2 |
| 3,847,757 | 11/1974 | Smith | 204/40 |
| 3,925,171 | 12/1975 | Jargon et al. | 204/56 R |
| 4,145,263 | 3/1979 | Tsutsui et al. | 204/35 R |

FOREIGN PATENT DOCUMENTS

| | | | |
|---|---|---|---|
| 1258185 | 2/1961 | France . | |
| 2053038 | 4/1971 | France . | |
| 2362056 | 3/1978 | France . | |
| 2362943 | 3/1978 | France . | |
| 2385818 | 10/1978 | France . | |
| 47-45253 | 11/1972 | Japan | 204/56 R |
| 4835136 | 10/1978 | Japan . | |

*Primary Examiner*—Gerald L. Kaplan
*Assistant Examiner*—William Leader
*Attorney, Agent, or Firm*—Sughrue, Mion, Zinn, Macpeak and Seas

[57] ABSTRACT

The invention relates to mild steel sheet, having deposited on at least one of its major faces a sub-layer of tin in an amount of 0.1 to 1.05 g/l and a composite coating containing chronmium and chronmium oxide. The content of chromium in the composite coating is more than 5 $\mu g/cm^2$ while the content of chromium oxide in the coating, expressed in terms of chromium, is less than 2.5 $\mu g/cm^2$.

The resultant sheets give improved welds when joined by electric welding and are particularly suited for making can bodies for food cans.

9 Claims, No Drawings

STEEL SHEET CARRYING A PROTECTIVE LAYER AND PROCESS FOR PRODUCING SUCH A SHEET

FIELD OF THE INVENTION

The present invention relates in general terms to mild steel sheets of the type normally used for the manufacture of metal containers, in particular food cans.

DESCRIPTION OF PRIOR ART

In general, food cans are formed from a body which is closed by two end pieces. Traditionally, the body is produced by rolling a metal strip, so that the lips of the latter are superposed when rolling is complete and these lips then have to be joined together. The end pieces which are separated from this body, are then joined to the body as by double seaming.

It is known to produce cans in which one of the ends is a single integral unit with the body by stamping and/or drawing the whole from a single blank, but this method of production requires a blank made of a material which has a particular suitability for shaping.

The normal method used to join together the lips of a can body formed by rolling a metal strip is seaming, most frequently by using soldering or organic cementing, or roller spot welding.

Electric welding, particularly when compared with seaming by soldering, has the advantage of having a lower consumption of metal sheet, of not requiring the addition of any other material, and of leading to minimum extra thicknesses, the latter factor facilitating satisfactory subsequent double seaming of the end pieces. Because of these advantages this technique is fairly attractive; unfortunately, this technique can only be used if the metal sheet for making the cans has a reduced contact resistivity, and, in practice, this has hitherto limited its field of application, as specified below.

Roller spot welding, which constitutes a particular form of resistance welding for producing leaktight linear welds, is usually performed by moving the sheets of metal between two electrodes in the form of rollers clamped against one another. The sheets of metal are moved so that the electrode rollers travel along the line of the weld which it is desired to produce and repeated pulses of current are passed between the rollers in such a manner that the resultant weld spots partially overlap. This method of resistance welding suffers from particular constraints related to the movement of the assembled sheets. The clamping pressure is at a maximum at the point of contact of the rollers coinciding with the weld spot; it is not possible to provide a squeezing stage, or the prior application of pressure, in order to reduce the contact resistance between the sheets of metal and the electrodes before the current is passed. The proximity of the weld spots makes it necessary for the pulses of current to be well gauged and for the heated zones to be well located in order to avoid either erratic overheating or weld deficiencies. It is thought, and this is confirmed by experiment, that the contact resistances between the rollers and the sheets of metal which are parasite resistances, must be low and uniform if the welds are to be reliable. When conventional tin plate is used to form food cans it is known according to French Pat. No. 1,258,185 to use copper wires in order to prevent deterioration of the roller surfaces from causing variations in contact resistance. The copper wires move with the sheets of metal and form auxiliary electrodes in contact with the rollers, which possess grooves of suitable profile.

Corrosion of metal used to make food cans is detrimental in that it detracts from the properties of the metal and impairs the taste of the canned food. It is therefore necessary to protect the metal to prevent corrosion from taking place. It has been customary until recently to provide this protection by means of a tinning operation, optionally followed by lacquering. As is known, the tin-coated material obtained is normally referred to as tin plate. It is formed of a mild steel sheet, coated on the surface with a protective layer of tin. The tin can remain free (i.e. unalloyed) or, by combination with the iron in the underlying metal sheet, it can be totally or partially converted into an iron/tin alloy, for example by flow melting.

However, the present cost of tin, owing to depleting stocks of raw material, has now favoured another process for protecting sheet steel of this type, which comprises subjecting the sheet metal to an electrolytic treatment by passing it through a chromium-plating bath formed of a dilute aqueous solution of chromium trioxide containing, for example, sulphuric acid as a catalyst. For convenience, this treatment is referred to below as a chromium-plating treatment. A process of this type is described, for example, in French Pat. No. 1,365,368. It leads to the formation of a material, commonly referred to as TIN-FREE STEEL (hereinafter referred to as TFS), which is a mild steel sheet, coated on the surface with a protective layer containing chromium metal and chromium oxide.

Apart from the resulting saving of tin, this material exhibits various advantages, in particular that of good adhesion of lacquers. However, it exhibits a major disadvantage, namely a particularly high contact resistivity, which renders any roller spot welding impracticable. It is for this reason that its use in food canning is currently restricted to the manufacture of can ends and of certain drawn bodies. Roller spot welding is generally used only with tin plate, since it can only be used with TFS if the TFS is specially treated.

In general terms, according to the present invention there is a process for the production of a material which, like TFS, comprises a composite layer of chromium metal and chromium oxide, but which, in particular, is very suitable for roller spot welding because its coating contains a limited amount of chromium oxide and because of the presence of a thin sub-layer of tin.

In addition, the materials according to the invention possess a corrosion resistance which is greater than that of TFS, because of the fact that a layer of tin/iron alloy is formed, by diffusion in the solid state, during a heat treatment for curing the organic coatings.

Admittedly, it has already been proposed to combine a layer based on tin with a layer based of metallic chromium and chromium oxide. However the manufacture of food cans by roller spot welding of such materials has not been suggested.

In French Patent Application No. 77/25340 filed on Aug. 18, 1977, Publication No. 2,362,056, on the one hand, the tin-based layer forming a first protective layer is flow-melted and thus consists of a tin/iron alloy, and, on the other hand, the coating which covers this first protective layer, and which itself forms a second protective layer resulting from a chromium-plating operation of the type explained above, essentially consists of chromium oxide, the content of metallic chromium metal in this coating preferably being zero and always less than 0.005 g/m$^2$, that is to say 0.5 $\mu$g/cm$^2$, of surface treated.

Although this arrangement leads to materials which are well suited to organic cementing and to shaping, the materials are not suitable for roller spot welding, which, moreover, is not envisaged. In fact, the preferred presence of chromium oxide in the surface coating of this material leads to resistivity values which are incompatible with roller spot welding, unless a difficult and expensive grinding of the coating is carried out beforehand.

The same applies to the material described in French Patent Application No. 77/25,886 filed on Aug. 24, 1977, Publication No. 2,362,943, which differs from the above material only by the fact that the tin-based sub-layer consists of free tin.

Japanese Pat. No. 48/35,136 describes a material of this type in which the layer of free tin is the outer layer, the layer of chromium and chromium oxide thus forming a sub-layer lying under this coating. However, in this case, the application of the layer of tin can only detract from the protection performance otherwise expected of the sub-layer of chromium and chromium oxide.

In French Patent Application No. 78/09,425 filed on Mar. 31, 1978, Publication No. 2,385,818, the first protective layer is exclusively a tin/iron alloy, the initially deposited tin being systematically flow melted to form the alloy, and a chromium-based passivating coating is applied to the sub-layer produced in this way. This coating, the characteristics of which are not specified, is obtained either by passage through a conventional sodium dichromate electrolysis bath, for the cathodic passivation of tin plate, or by passage through a conventional chromium plating bath of the type indicated above for the production of a TFS-type material.

In the first case, the resulting deposit on chromium and chromium oxide is so thin that the corrosion resistance which results therefrom is insufficient. In the second case, the deposit obtained must necessarily have a content of chromium oxide which is too large for permitting the use of electric roller spot welding of the resulting material.

French Patent Application No. 70/23,705, Publication No. 2,053,038, relates to the deposition of mixed chromium/chromium oxide coatings on sheet metal substrates, in particular galvanised plate or tin plate, with the main object of improving corrosion resistance, the weight ratio chromium/chromium oxide varying within wide limits, namely from 4/1 to 1/30. The disclosure of this patent application is particularly concerned with the study of the deposition of mixed coatings on galvanised substrates. On galvanised substrates the mixed coating is said to provide an improvement in corrosion resistance and reduces the degradation of the welding electrodes which are used in conventional spot welding of steel sheets. It can be understood that this refers specifically to the difficulties in welding galvanised steel, in which the volatilisation of zinc causes degradation of the electrodes. Furthermore, as regards the tin coating, the said patent application only envisages improvements in the corrosion resistance of tin-coated metal sheets which have layers of tin of a thickness customary in tin plate and regardless of whether the tin is or is not alloyed to the underlying iron by melting.

BRIEF SUMMARY OF THE INVENTION

The present invention relates more precisely to a process for protecting a mild steel sheet, which leads to a material suitable for roller spot welding, the protective coating comprising a sub-layer of tin of very reduced thickness.

According to a first aspect of the present invention, there is provided a process for the production from mild steel sheets of a steel sheet carrying a protective layer suitable for the manufacture of metal containers, in particular food cans, the protected steel sheet possessing an electrical contact resistance which is sufficiently low to permit roller spot welding during the manufacture of said containers, which process includes the steps of:

(a) depositing on the surface of the metal sheet a layer of tin in an amount of from 0.1 to 1.5 g/m$^2$ of the surface area of the metal sheet to form a layer of tin which is unalloyed to the steel, and then (b) depositing a composite layer of metallic chromium and chromium oxide on the tin-coated metal sheet, the said composite layer being deposited so that the said composite layer contains at least 5 micro-grams of metallic chromium per square centimeter of the surface area of the metal sheet (5 $\mu$g/cm$^2$) and from 0.6 to 2.5 $\mu$g/cm$^2$ of chromium in oxidized form.

According to a further aspect of the present invention there is provided a steel sheet carrying a protective layer and being suitable for the manufacture of metal containers, in particular food cans, the protected steel sheet having a corrosion resistance which is greater than that of TFS-type materials, and an electrical contact resistance which is sufficiently low to permit roller spot welding during the manufacture of the containers, the steel sheet comprising a sheet of mild steel having a layer of tin deposited on the surface of the sheet, in an amount of from 0.1 to 1.5 g/m$^2$, the tin layer not being alloyed with the steel, and a composite layer of chromium metal and chromium oxide deposited on the resulting tin-coated metal sheet, the said composite layer containing at least 5 micrograms per square centimeter of metallic chromium (5 $\mu$g/cm$^2$) and from 0.6 to 2.5 $\mu$g/cm$^2$ of chromium in oxidized form.

DETAILED DESCRIPTION OF THE INVENTION

The lower limiting value specified for the thickness of the layer of tin (expressed in the units normally used by those skilled in the art) corresponds, to the minimum essential for obtaining the desired technical result. The upper limit of the thickness of tin corresponds to the value which should not be exceeded in order to save tin; above this limit the reduction in the contact resistivity, using the specified composition of the chromium composite layer, becomes insignificant. However, it should be noted that the layer of tin must not have given rise to intermetallic iron-tin compounds.

Preferably, the composite layer contains at most 10 $\mu$g/cm$^2$ of metallic chromium.

The tinning operation can be carried out by electrolysis. This is a known technique which will not be described in detail in this application. It will suffice to say that the elctrolysis is normally carried out after degreasing the steel sheet in an alkaline medium, rinsing with water, pickling in an acid medium and again rinsing with water. Any acid tinning electrolyte, such as, for example, stannous sulphate, stannous chloride and stannous fluoroborate, or any alkaline tinning electrolyte, such as, for example, sodium stannate or potassium stannate may be used for the electrolysis.

With an acid tinning electrolyte, the tinning conditions are preferably as follows:

concentration of stannous ions in the bath: 1.5 to 40 g/liter, concentration of acid in the bath, e.g. sulphuric acid or a phenolsulphonic acid: 1.0 to 20 g/liter of equivalents of $H_2SO_4$ concentration of added products in the bath, for example sulphones, diphones or a product sold as ENSA: less than 30 g/liter temperature of the bath: 30° C. to 60° C.

current density: 5 to 50 A/dm$^2$

The steel, degreased, pickled and rinsed beforehand, is treated as the cathode, the anode consisting of pure tin.

The tinning operation may also advantageously be carried out by means of a pickling/tinning process as described, in particular, in French Pat. No. 1,500,185 of Aug. 8, 1966. In this case, the operation is simply preceded by degreasing of the steel sheet in an alkaline medium and rinsing with water, the acid pickling operation being carried out simultaneously with the desired tinning operation. The advantage of a cleaning/tinning operation of this type is, in particular, that it leads to a slight deposit of free tin, which is particularly adhesive and uniform and is very suitable for the production of the material sought according to the invention.

In the same way as an electrolytic tinning bath, the pickling/tinning bath used consists of an aqueous solution of acid, containing stannous ions, but it has a lower concentration of stannous ions and a higher acid content. The steel sheet, degreased and rinsed beforehand, is treated therein as the cathode, as above, but this time, the anode consists of a material possessing a high resistance to anodic dissolution, for example graphite or ferrosilicon. The operating conditions are preferably as follows:

concentration of stannous ions in the bath: 0.3 to 1.5 g/liter concentration of acid in the bath, e.g. sulphuric acid or a phenolsulphonic acid: 15 to 100 g/liter of equivalents of $H_2SO_4$ temperature of the bath: 20° C. to 80° C.

current density: 10 to 60 A/dm$^2$

In practice, it is important for the concentration in the bath of hydrogen ions originating from the acid to be sufficiently high, relative to the concentration of stannous ions, in order that the cathode efficiency in terms of deposited metal is low, namely less than 50% and preferably between 5 and 25%.

In all cases, whether electrolytic tinning or pickling/-tinning, no flow melting of the deposited tin is carried out, this tin thus remaining in the form of free, tin, that is to say in the form of unalloyed tin.

In principle, the chromium plating treatment can also be carried out in accordance with known techniques. Thus, for example, a chromium plating bath may be an electrolysis bath of the type described in the above-mentioned French Pat. No. 1,365,368, that is to say an electrolysis bath which is formed of a dilute aqueous solution of chromium trioxide, containing, for example, sulphuric acid as a catalyst, and in which the sheet metal to be treated forms the cathode. With a bath of this type, a man skilled in the art will know how to control, exactly, the amount of chromium metal deposited as a function of the experimental conditions used, in particular the current density, since the amount of chromium metal deposited will obey Faraday's law with an efficiency which is relatively mediocre but is known and constant. It is thus easy to proceed in such a manner that the amount of metallic chromium metal deposited is the amount envisaged according to the invention, as specified above.

A man skilled in the art will also know how to achieve the specified amounts of chromium oxide in the composite layer, either by carrying out the chromium plating treatment accordingly, or, if the latter leads to a value which is higher than the desired value by carrying out a rectifying process of dissolution by leaving the treated sheet metal in the chromium plating bath for a period of time without passing current, which process is capable of reducing this content to the desired value.

According to the invention, the process is preferably carried out using a chromium plating bath containing chromium trioxide, optionally with sulphuric acid as a catalyst, the chromium content being from 25 to 50 g/liter. Furthermore, the content of trivalent chromium, $Cr^{3+}$, in the bath is preferably equal to at most 0.5 g/liter, in particular at the start of the chromium plating treatment, in order to avoid the appearance of discoloration zones (interference layers). It is therefore possible to envisage, at least for the first bath in the case where the chromium plating treatment is carried out in several successive baths, a continuous circulation of the bath with passage over cation exchange resins, in order to keep its concentration of $Cr^{3+}$ ions at a value below the above-mentioned limit.

In addition, the chromium plating treatment preferably starts as soon as the tin-coated sheet has been immersed in the chromium plating bath, the sheet metal being cathodic before entering the bath, or before entering the first bath in the case where several successive baths are used.

These operating characteristics have been determined by experimentation by the applicants.

In all cases, an attempt is made to reduce the chloride content of the chromium plating bath as much as possible, in order to avoid excessive deposition of chromium oxide, this deposition being favoured by the presence of chloride ions.

In all cases, the chromium plating treatment is followed, in the customary manner, by at least one rinsing operation, a drying operation and a surface lubrication operation, for example using dioctyl sebacate or cottonseed oil.

The suitability of a metal sheet for roller spot welding is determined by determining the contact resistivity of the sheet metal. The contact resistivity is determined as follows:

Two copper electrodes, which have a contact area of 10 mm$^2$, are applied to both side of a sample and are well aligned. The voltage drop between the two electrodes at 25° C. is measured the measurement being carried out when a direct current of one ampere circulates between the two electrodes and when a contact pressure which is progressively raised to 1,400 bars (that is to say a clamping force of 1,400 Newtons), is applied to the electrodes. It is essential that the force has not exceeded the specified value before the current is passed, in order to reproduce conditions similar to those of roller spot welding.

As the TFS-type materials are always used after both their faces have been lacquered, two resistance measurements are carried out, one being on the material as produced through chromium plating and the other being on a sample of the same material, after stoving for 30 minutes at 200° C., which simulates the stoving for curing of the lacquers.

The two resistances of the material, namely the resistance of the material as such and the resistance after stoving, are represented respectively as $R_{25}$ and $R_{200}$. It will be noted that, during stoving, the initially unalloyed tin partially diffuses into the steel substrate to give intermetallic iron-tin compounds, so that the resistance $R_{200}$ is predictably greater than the resistance $R_{25}$.

As roller spot welding is usually preceded by lacquering, under the normal conditions for the manufacture of metal containers, such as food cans made of TFS-type materials, it is the resistance $R_{200}$ which is indicative of the suitability for roller spot welding. In correlation with practical experiments on a roller spot welding apparatus, it has been established that this welding becomes unreliable and incompatible with mass production for resistances above $100\times10^{-5}$ ohms, and practically impossible for resistances above $1{,}000\times10^{-5}$ ohms (resistances measured on the material at the time of use, under the conditions specified above).

The present invention will now be illustrated by the following non-limiting Examples.

EXAMPLE 1

A cold reduced mild steel sheet, having a thickness of 0.21 mm, is electrolytically degreased in a solution containing 10 g/liter of sodium carbonate, and this sheet is then pickled in dilute sulphuric acid.

After it has been rinsed with water, the sheet of metal is subjected to an electrolytic tinning operation under the following conditions:

Composition of the electrolysis bath
Stannous tin: 30 g/liter
Para-phenolsulphonic acid (in equivalents of $H_2SO_4$): 15 g/liter
ETHOXYLATED ALPHA NAPHTHOSULPHONIC ACID (ENSA): 2 g/liter
Temperature of the electrolysis bath: 45° C.
Cathodic current density: 5 A/dm$^2$ Under these conditions, the weight of the coating of deposited free tin is 0.25 g/m$^2$.

After being rinsed with water, the sheet of metal covered in this way with a layer of free tin is subjected, as the cathode, to an electrolytic chromium plating treatment under the following conditions:

Composition of the electrolysis bath:
Chromium trioxide: 60.0 g/liter
Sulphuric acid: 0.6 g/liter
Temperature of the electrolysis bath: 50° C.
Cathodic current density: 55 A/dm$^2$ Under these conditions, the deposited layer based on chromium and chromium oxide contains 9.2 $\mu$g/cm$^2$ of metallic chromium and 2.1 $\mu$g/cm$^2$ of chromium in oxcidized form (adjusted by redissolution).

After chromium plating, the treated sheet of metal is rinsed with water, dried and coated with a thin film of dioctyl sebacate.

Under the experimental conditions specified above, the electrical resistance of the resulting material are:

$R_{25}=8\times10^{-5}$ ohms
$R_{200}=20\times10^{-5}$ ohms

EXAMPLE II

The experimental conditions are substantially the same as those of Example I, with the following modifications:

For the tinning operation, the cathodic current density is 20 A/dm$^2$ and the weight of the coating of tin deposited is 1.05 g/m$^2$.

For the chromium plating treatment, the composition of the bath is:

Chromium trioxide: 82 g/liter
Sulphuric acid: 0.8 g/liter
Trivalent chromium ions: 0.2 g/liter
Temperature of the bath: 52° C.
Cathodic current density: 48 A/dm$^2$ Under these conditions, the composite layer contains 7.4 $\mu$g/cm$^2$ of metallic chromium and, by subsequent dissolution, the content of chromium in oxcidized form is reduced to 1.6 $\mu$g/cm$^2$.

The resistances measured are:

$R_{25}=5\times10^{-5}$ ohms
$R_{200}=10\times10^{-5}$ ohms

EXAMPLE III

The experimental conditions are the same as those of Example I, except that the conditions of the tinning operation, are as follows:

Composition of the electrolysis bath:
Stannous sulphate: 63.3 g/liter
Para-phenolsulphonic acid (in equivalents of $H_2SO_4$): 15 g/liter
Sulphones: 6 g/liter
Wetting agent: 0.1 g/liter
Temperature of the electrolysis bath: 40° C.
Cathodic current density: 8 A/dm$^2$ Under these conditions, the weight of the coating of deposited free tin is 0.25 g/m$^2$.

The content of metallic chromium in the layer of chromium and chromium oxide, deposited during the subsequent chromium plating treatment is 7.1 $\mu$g/cm$^2$ and the content of chromium in oxcidized form is 1.9 $\mu$g/cm$^2$.

The electrical resistances of the resulting material are:

$R_{25}=6\times10^{-5}$ ohms
$R_{200}=50\times10^{-5}$ ohms

EXAMPLE IV

The experimental conditions are the same as those of Example I, except that the tinning operation is carried out by electrolytic pickling/tinning, under the conditions given below, so that the sheet of metal to be treated is subjected beforehand only to degreasing followed by rinsing:

Composition of the electrolysis bath:
Stannous sulphate: 1.2 g/liter
Acid, for example sulphuric acid: 100 g/liter
Temperature of the electrolysis bath: 35° C.
Cathodic current density: 15 A/dm$^2$ Under these conditions, the weight of the coating of deposited free tin is 0.3 g/m$^2$.

The content of metallic chromium metal in the layer of chromium and chromium oxide, deposited during the subsequent chromium plating treatment is 7.0 $\mu$g/cm$^2$ and the content of chromium in oxcidized form is 1.9 $\mu$g/cm$^2$.

The electrical resistances of the resulting product are:

$R_{25}=5\times10^{-5}$ ohms
$R_{200}=40\times10^{-5}$ ohms

It is observed from the above examples that the resistance $R_{25}$ is less than $10\times10^{-5}$ ohms and the resistance $R_{200}$ is less than $100\times10^{-5}$ ohms.

Comparison experiments were carried out with a conventional tin plate, samples of material obtained in accordance with Examples II and IV, samples of material produced in accordance with the teachings of French Patent Application No. 78/09,425 that is to say produced by forming an intermetallic iron-tin compound by on-line flow-melting between the tinning and chromium plating operations (referred to as prior art), and samples of TFS, i.e. the material itself (referred to as TFS-1) and after selective removal of the layer of chromium oxide (referred to as TFS-2). In each case the thickness of the layer of unalloyed (or free) tin, after stoving at 200° C. for 30 minutes, was measured analytically.

The results are given in the following table:

| Material | Sn deposited g/m² | Material not stoved: Free Sn g/m² | Material not stoved: $R_{25}$ $\times 10^{-5}$ ohms | After stoving: Free Sn g/m² | After stoving: $R_{200}$ $\times 10^{-5}$ ohms |
|---|---|---|---|---|---|
| Tin plate | 2.8 | 2.0 | 4–6 | 1.8 | 4–6 |
| According to Example IV | 0.3 | 0.3 | 5–8 | 0.0 | 40–80 |
| According to Example II | 1.0 | 1.0 | 4–6 | 0.2 | 6–12 |
| Prior art | 0.4 | 0.0 | 80–90 | 0.0 | 400–600 |
| TFS-1 | 0.0 | 0.0 | >2,000 | 0.0 | >2,000 |
| TFS-2 | 0.0 | 0.0 | 200–300 | 0.0 | 300–400 |

It will be noted that the materials obtained by the process according to the invention show, after stoving, a resistance which is at most of the same order as the resistance of the material of the prior art, in the not stoved state, under conditions where stoving caused the apparently complete disappearance of the free tin, whereas, on stoving, the material of the prior art showed a considerable increase in its contact resistance. It would therefore seem that the presence of free tin during the deposition of the composite layer leads to an improvement in the suitability for roller spot welding, even if subsequently the free tin has disappeared, or at least if this free tin is no longer detectable.

It should be pointed out that the samples of TFS used in the experiments had been subjected to chromium plating under conditions which were the same as those of Example IV. Apart from the fact that the results confirm that the combination of free tin, metallic chromium metal and chromium oxide exhibits effects which do not bear comparison with the sum of the effects of the constituents taken in isolation or in pairs, it will be understood that an installation designed for carrying out the process according to the invention is capable of producing TFS-type materials in the part where chromium plating is carried out.

Of course, the invention is not limited to the examples which have been described, but encompasses all the modified embodiments thereof. In particular, the conditions for deposition of the tin or the composite layer of chromium and chromium oxide can form the subject of modifications which those skilled in the art will know how to carry out on the basis of the data indicated in the description. For example, it is possible to envisage the deposition of a different amount of tin on both faces or even conventional tinning on one of the faces.

Furthermore, it is quite obvious that, although the object of the process according to the invention is to obtain a material possessing a particular suitability for roller spot welding, the invention is not limited to the use of this material for welding by means of roller spot welding.

What is claimed is:

1. A process for the production from mild steel sheets of a steel sheet carrying a protective layer suitable for the manufacture of metal containers, in particular food cans, the protected steel sheet possessing an electrical contact resistance which is lower than $100\times10^{-5}$ ohms, so as to permit roller spot welding during the manufacture of said containers, which process includes the steps of:

(a) depositing on the surface of the metal sheet a layer of tin in an amount of from 0.1 to 1.05 g/m² of the surface area of the metal sheet to form a layer of tin which is unalloyed to the steel, and then (b) electrolytically depositing a layer of chromium metal and chromium oxide on said unalloyed tin layer the said layer being deposited so that the said layer contains at least 5 micrograms per square centimeter of the surface area of the metal sheet (5 μg/cm²) of metallic chromium and from 0.6 to 2.5 μg/cm² of chromium in oxidized form.

2. A process according to claim 1, wherein the layer of chromium metal and chromium oxide contains at most 10 μg/cm² of chromium metal.

3. A process according to claim 1, in which the layer of chromium metal and chromium oxide is deposited by a process which comprises passing the tin-coated metal sheet, which acts as the cathode, through an electrolysis bath containing a solution of chromium trioxide, and after the composite layer has been deposited, reducing the content of chromium oxide in this layer to a specified range.

4. A process according to any one of claims 1, 2 or 3, wherein the layer of chromium metal and chromium oxide is deposited by a process which comprises passing the tin-coated metal sheet, which acts as the cathode, through at least one electrolysis bath containing a solution of chromium trioxide, and wherein in at least a first electrolysis bath, the content of $Cr^{3+}$ ions is kept at a value of at most 0.5 g/liter.

5. A process according to claim 4, wherein the specified content of $Cr^{3+}$ ions is maintained by passing the bath over a cation exchange resin.

6. A process according to claim 4, wherein the total content of chromium in the bath, calculated as chromium, is from 25 to 50 g/liter.

7. A process according to claim 4, wherein the tin-coated metal sheet is made cathodic relative to an anode, before entering at least the first bath.

8. A steel sheet carrying a protective layer and being suitable for the manufacture of metal containers, in particular food cans, the protected steel sheet having an electrical contact resistance which is lower than $100\times10^{-5}$ ohms, so as to permit roller spot welding during the manufacture of the containers, the steel sheet comprising a sheet of mild steel having a layer of tin deposited on the surface of the sheet, in an amount of from 1.0 to 1.05 g/m², the tin layer not being alloyed with the steel, and a layer of metallic chromium and chromium oxide deposited on the resultant tin-coated metal sheet, the said layer containing at least 5 micrograms per square centimeter of metallic chromium (5 μg/cm²) and from 0.6 to 2.5 μg/cm² of chromium in oxidized form.

9. A steel sheet according to claim 8, wherein the layer of chromium metal and chromium oxide contains at most 10 μg/cm² of metallic chromium.

* * * * *

UNITED STATES PATENT AND TRADEMARK OFFICE

CERTIFICATE OF CORRECTION

PATENT NO. : 4,421,828

DATED : December 20, 1983

INVENTOR(S) : RAYMOND ALLOUE AND CLAUDE MERGEY

It is certified that error appears in the above-identified patent and that said Letters Patent is hereby corrected as shown below:

Claim 8, line 9, delete "1.0" and insert --0.1--.

The first inventor should be --Raymond Allouf--, not "Raymond Alloue".

Signed and Sealed this

*Tenth* Day of *July 1984*

[SEAL]

*Attest:*

GERALD J. MOSSINGHOFF

*Attesting Officer*

*Commissioner of Patents and Trademarks*